United States Patent [19]

Solheim

[11] Patent Number: 4,667,820

[45] **Date of Patent: * May 26, 1987**

[54] THROAT STRUCTURE FOR GOLF CLUB BAGS

[76] Inventor: John A. Solheim, 529 Wakonda La., Phoenix, Ariz. 85023

[ * ] Notice: The portion of the term of this patent subsequent to Jun. 24, 2003 has been disclaimed.

[21] Appl. No.: 829,920

[22] Filed: Feb. 18, 1986

Related U.S. Application Data

[63] Continuation-in-part of Ser. No. 587,453, Mar. 8, 1984, Pat. No. 4,596,328, and Ser. No. 684,102, Dec. 10, 1984, Pat. No. 4,600,100.

[51] Int. Cl.[4] ..... A63B 55/00

[52] U.S. Cl. ..... 206/315.6; 206/315.3

[58] Field of Search ..... 206/315.2–315.8; 248/96; 211/70.2; 280/DIG. 6; 273/32 E

[56] References Cited

U.S. PATENT DOCUMENTS

| | | | |
|---|---|---|---|
| 1,271,784 | 7/1918 | Simpson | 206/315.6 |
| 1,621,107 | 3/1927 | Cross | 206/315.6 |
| 1,726,245 | 8/1929 | Shelton | 206/315.4 |
| 1,838,699 | 12/1931 | McMonies et al. | 206/315.6 |
| 1,902,644 | 3/1933 | Hotze | 206/315.8 |
| 1,968,723 | 7/1934 | Thorsen | 206/315.6 |
| 2,256,521 | 9/1941 | Kirkpatrick et al. | 206/315.3 |
| 2,282,842 | 5/1942 | Abell | 206/315.7 X |
| 3,139,132 | 6/1964 | Shiller | 206/315.6 |
| 3,331,419 | 7/1967 | Bencriscutto | 206/315.6 |
| 3,534,795 | 10/1970 | Wiedenmeier | 206/315.6 |
| 4,130,153 | 12/1978 | Zopf | 206/315.6 |
| 4,266,589 | 5/1981 | Cochran | 206/315.3 |
| 4,332,283 | 6/1982 | Rader | 206/315.6 |
| 4,596,328 | 6/1986 | Solheim | 206/315.3 X |
| 4,600,100 | 7/1986 | Solheim | 206/315.6 |

FOREIGN PATENT DOCUMENTS

| | | | |
|---|---|---|---|
| 21884 | 8/1930 | Australia | 206/315.5 |
| 206625 | 11/1923 | United Kingdom | 206/315.5 |
| 607387 | 8/1948 | United Kingdom | 280/DIG. 6 |
| 859116 | 1/1961 | United Kingdom | 206/315.7 |

*Primary Examiner*—William Price
*Assistant Examiner*—Sue A. Weaver
*Attorney, Agent, or Firm*—Herbert E. Haynes, Jr.

[57] ABSTRACT

A throat structure for use in the open top of a golf bag includes the combination of ring-shaped body with a special divider therein which separates the opening into the golf bag into four golf club segregation areas. The special divider is provided with a pair of cross bars that are interconnected at their centers by a transverse rib with the cross bars being angular so that the golf clubs containable in the segregation areas will tend to collect in predetermined locations in the segregation areas when the golf bag is being carried to facilitate golf club selection and removal and to minimize golf club entanglement.

23 Claims, 12 Drawing Figures

FIG. 4
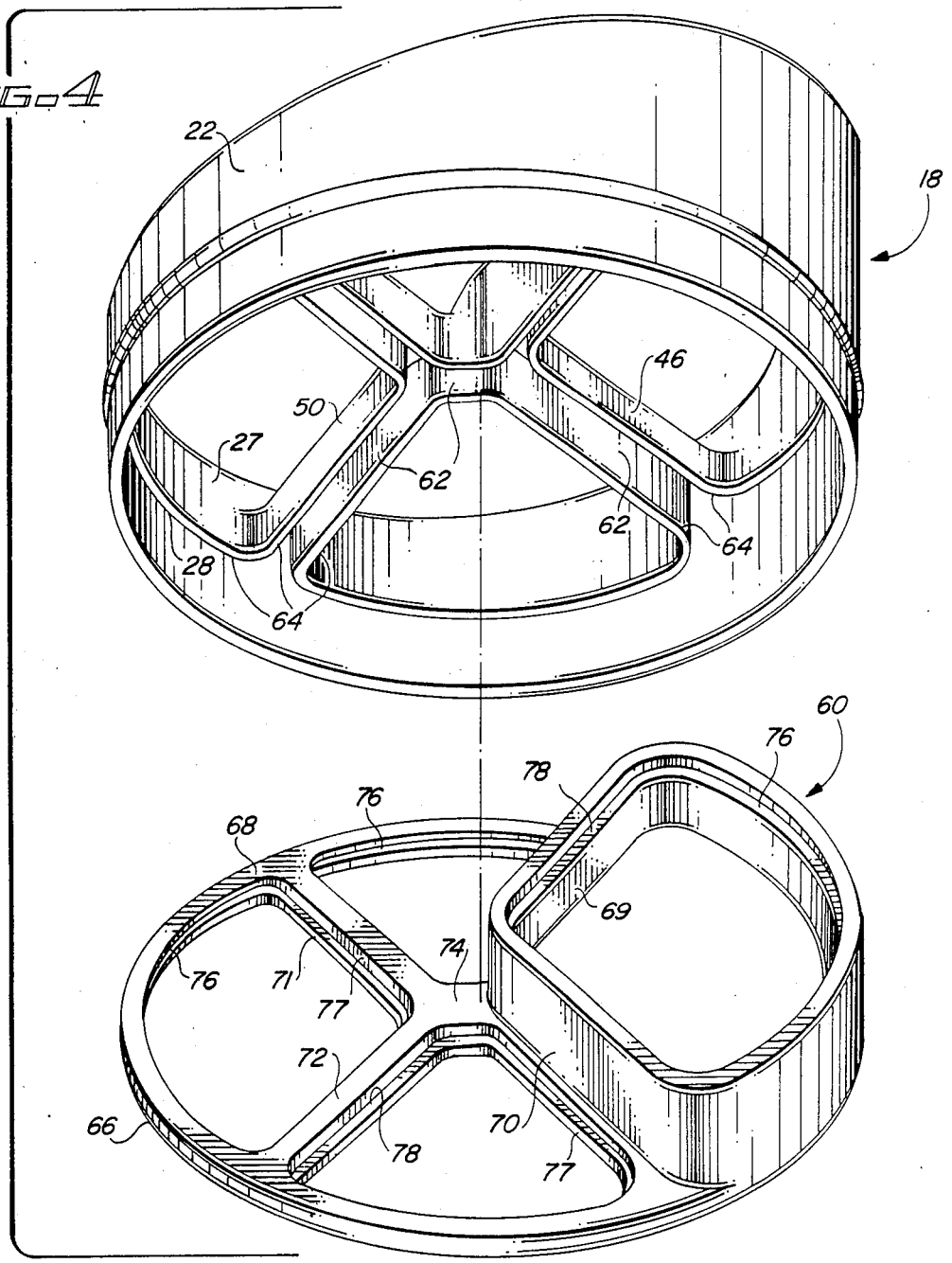
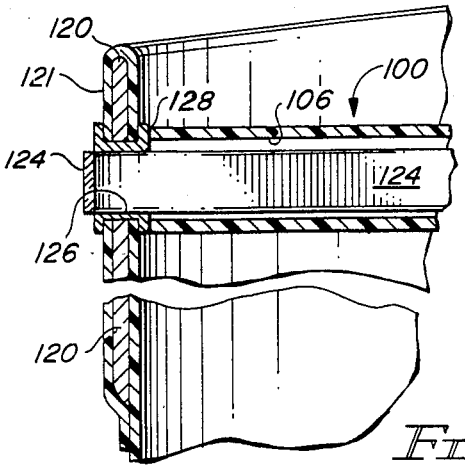
FIG. 11
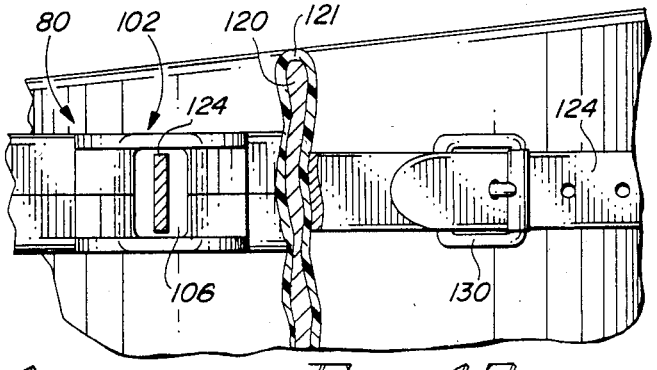
FIG. 12

FIG. 9
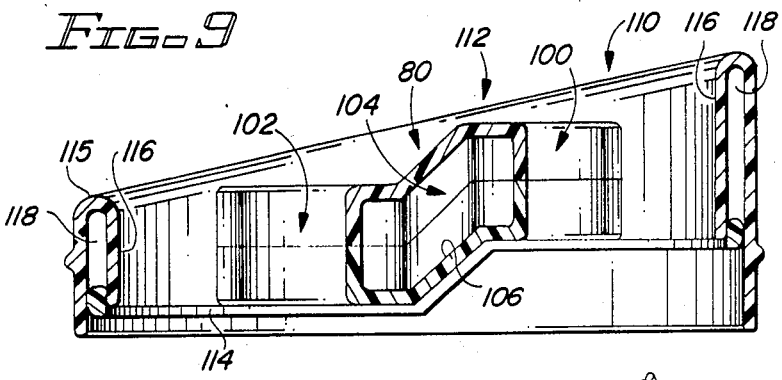
FIG. 10
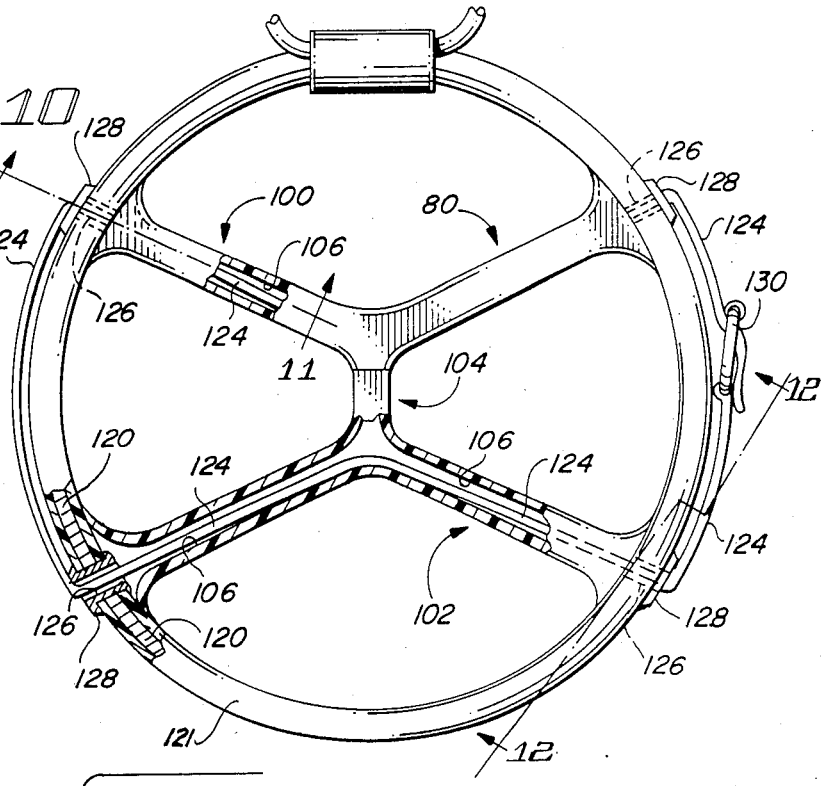
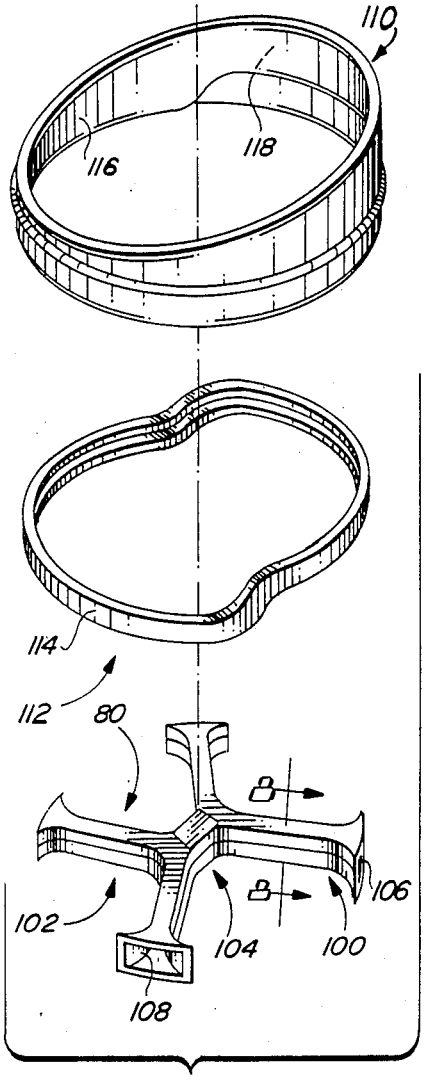
FIG. 6
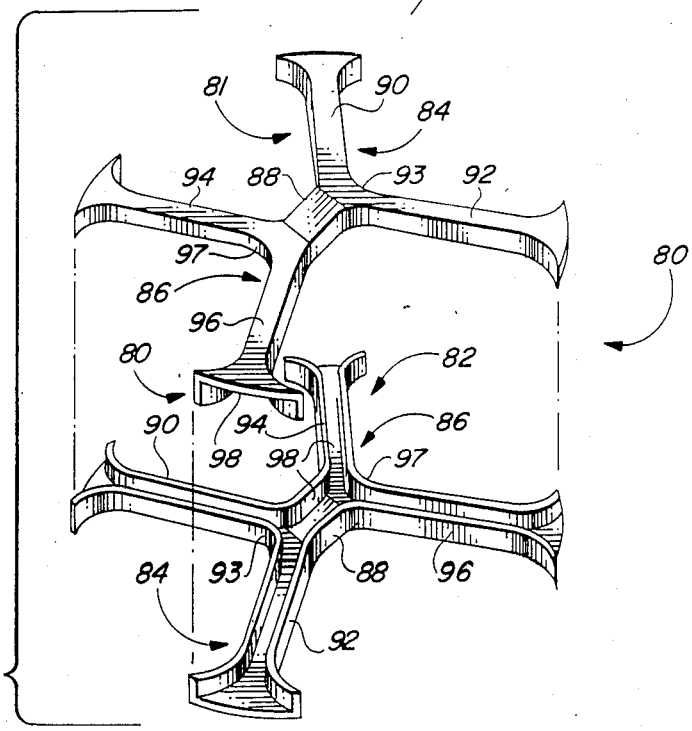
FIG. 7

THROAT STRUCTURE FOR GOLF CLUB BAGS

CROSS REFERENCE TO RELATED PATENT APPLICATIONS

This application is a Continuation-in-Part of a copending prior application Ser. No. 587,453, filed on Mar. 8, 1984, U.S. Pat. No. 4,596,328 for THROAT STRUCTURE FOR GOLF CLUB BAGS, and of a copending prior application Ser. No. 684,102, filed Dec. 10, 1984, U.S. Pat. No. 4,600,100 for THROAT STRUCTURE FOR GOLF CLUB BAGS, all by the same inventor.

FIELD OF THE INVENTION

This invention relates generally to bags for carrying golf clubs and more particularly to an improved throat structure for facilitating placement and removal of the golf clubs in the bag and providing improved golf club group segregation.

DESCRIPTION OF THE PRIOR ART

Golf clubs have been stored, carried, and otherwise transported in especially designed golf bags for many years. Most golf bags are in the form of a tubular fabric container generally of cylindrical configuration having a closed bottom and an open top, or throat, through which the golf clubs are inserted into and removed from the bag. When golf clubs are in such bags, the grips of the clubs are in resting engagement with the closed bottom of the bag, and the heads of the clubs extend more or less axially from the open throat of the bag. By positioning the golf clubs in the bag in this manner, the clubs can be identified for club selection purposes by a golfer in that the configurations of the heads vary in accordance with the intended usage and are for the most part generally provided with suitable identifying indicia.

Although the number of golf clubs carried in golf bags will vary, the rules of golf dictate that the maximum number of clubs carried while playing will be fourteen. From this, it will be appreciated that even though the clubs vary in configuration and are provided with identifying indicia, selecting a desired club from the relatively large number of clubs can be distracting and sometimes frustrating. And, after the desired club has been identified, removal of the club is not always easy in that the clubs can, and often do, become entangled in the bag.

For the above reasons, most golf bags are provided with throat structures which separate the clubs into segregated groupings which are, of course, determined by individual preference. For example, the woods are usually segregated by the throat structure of the golf bag into one group, the low number, or long and middle distance irons into another group, and the higher number, or short distance irons, and the putter into a third group.

The open top, or throat structure of most prior art golf bags are usually in the form of a substantially circular ring-shaped body having a spaced pair of linear dividers placed therein so that the dividers form equal chords within the circular ring-shaped body. The dividers are usually tubular structures formed by folding a relatively heavy gage, usually synthetic, leather-like material, and stitching the aligned longitudinal edges together. Such dividers are normally mounted in the ring-shaped body by an elongated strap which is threadingly passed through the tubular dividers and through suitable openings in the body with a buckle being used to secure the strap, and thus the dividers in place.

Throat structures which are divided as described above are commonly used in the variously sized golf bags from the relatively small diameter light weight golf bags to the relatively large diameter heavy golf bags. In any event, this divider configuration provides three approximately equally sized open areas, most golfers place their woods, usually three, in one area, their putter and three or so short distance irons in another area, with the central area being used for containment of the middle and long distance irons. While these open areas are a considerable improvement over a non-divided throat structure with regard to segregation and ease of club removal, the club entanglement problem is still quite bad particularly with regard to the central opening which can contain as many as seven or eight clubs if the golfer divides the clubs in the usual manner as described above.

In some golf bags, a third divider is sometimes employed to further provide the throat structure with an additional number of club separating open areas. The third divider is formed in the same manner as described above and is mounted below the other two dividers and lies on a diameter of the ring-shaped body and is transverse with respect to the other two dividers. Therefore, the third divider will provide six separate openings through the ring-shaped body. This type of throat structure is limited for use in relatively large diameter golf bags in that if used in relatively smaller diameter bags, the open area of each of the six openings would be too small and would therefore hamper facile insertion and removal of the golf clubs.

In view of the above, it will be seen that in most instances, the three open golf club segregation areas in many of the prior art golf bags is not enough for ideal golf club group segregation purposes, and the six open areas provided in other prior art structures is too many.

In yet another prior art golf bag, the throat structure is divided into four open club segregation areas which is believed to be a proper number for ideal club group segregation purposes. This four open club segregation area throat structure is formed by employing the two linear dividers in the ring-shaped body, in the same manner as the first hereinbefore described throat structure, and interconnecting the dividers with a cross rib at the centers thereof. This divides the central opening into two equal halves.

In all prior art golf bags known to me, another shortcoming exists, and for clarity of the description of this shortcoming, the first hereinbefore described prior art golf bag throat structure will be employed in the description.

As is well known, when a golf bag is carried it will normally be disposed at an angle relative to the ground with the throat structure of the bag lying in a more or less upwardly facing angular attitude. Therefore, the open golf club group segregation areas provided in the golf bag throat structures may be defined as including an upper opening, an intermediate opening, and a lower opening. The lower portions of the upper and intermediate openings are defined by the linear dividers and when a golf bag is being carried, those linear dividers ideally lie in a horizontal attitude, with the shafts of the golf clubs resting thereon. However, it is virtually impossible to keep those dividers in the desired horizontal attitude and the result is that the golf clubs will tend to collect in one corner or the other of their respective segregated opening. This will not happen in the lower compartment in that the bottom portion thereof is defined by an arcuate part of the ring-shaped body. When the golf clubs gather in the corners as described above, the golf clubs in the upper and intermediate openings will gather in adjacent corners of their respective openings. This causes shifting and uneven weight distribution in the golf bag which makes it more difficult to carry the bag. However, a more troublesome problem results from the heads of the golf clubs becoming entangled, making individual club identification and extraction more difficult.

Another problem with the above described prior art golf bag throat structures is that of the golf clubs hanging-up, or catching in the throat structures as the clugs are being extracted from the golf bag. The grips provided on golf clubs are, by necessity, of larger diameter than the shafts of the clubs. Therefore, the grips present an annular lip which faces upwardly toward the throat structure when the golf clubs are in the golf bag. Also, the golf club grips are tapered so that they gradually increase in diameter from the lips to the terminal ends thereof. A large part of the catching problem occurs at the corners of the open club segregation areas defined by the throat structures. In other words, at the intersections of the ends of the dividers and the ring-shaped body, and at the intersections of the dividers themselves in throat structures which are divided into more than the three open golf club segregation area. The lip of the golf club grips often catch in these corners and sometimes the clubs become wedged therein due to the tapered configuration of the grips. Catching also occurs on the inwardly facing edges of the dividers.

Therefore, a need exists for a new and improved golf bag throat structure which overcomes some of the problems and shortcomings of the prior art.

SUMMARY OF THE INVENTION

In accordance with the present invention, a new and improved golf bag throat structure is disclosed which has improved golf club segregation properties and improved golf club insertion and extraction characteristics.

The improved golf bag throat structure includes a ring-shaped body having a divider means which provides four especially configured open golf club segregation area in the throat. The divider means includes a pair of angularly bent and oppositely facing cross bars, each having a pair of arms which extend oppositely at a diverging angle from the center toward the ring-shaped body with their centers in spaced apart relationship, and the centers are interconnected by a relatively short center rib. The pair of arms of each cross bar are preferably disposed to define an obtuse included angle with the included angle between the adjacent pairs of the arms of the two cross bars being acute.

With the divider means being configured as described above, and with a relatively short center rib, a pair of open diametrically opposed relatively large golf club segregation areas, i.e., the upper and lower openings, are provided, with the transverse diametrically opposed pair of open segregation areas, i.e., the intermediate openings, being relatively smaller.

The upper open segregation area is bounded on the bottom portion by the two arms of one of the divider cross bars with the two arms thereof sloping toward the center of that cross bar. Thus, when a golf bag having the throat structure of the present invention is being carried, the clubs that are grouped in the upper open segregation area will tend to be concentrated at a point slightly above the center of the ring-shaped body. The golf clubs grouped in the lower segregation opening, will tend to be concentrated in the center at the bottom of the ring-shaped body due to the arcuate portion of the ring-shaped body which defines the lower part of the lower opening. The golf clubs which are disposed in the two intermediate open segregation areas will tend to be concentrated at opposite sides of the ring-shaped body at the lowermost outwardly disposed corners of their respective open segregation areas due to the downwardly and oppositely sloping arms of the lower divider cross bar.

In view of the above, it will be seen that the above described dividing means will separate the groups of golf clubs as far apart from each other as is possible within the confines of the ring-shaped body, and will tend to hold the separated groupings in the widely separated locations, thus eliminating, or at least minimizing the prior art weight shifting problem and the head entanglement problem resulting from the different club groupings gathering in adjacent corners of their respective open segregation areas.

The problem with golf club clubs catching in the prior art golf bag throat structures when the clubs are being extracted therefrom is eased in the throat structure of the present invention by providing relatively large radii in the corners of the open areas, and the radii are sized to be at least approximately equal to the radius of the large end of golf club grips. The catching problem is further eased by providing means on the inwardly facing surfaces of the divider means, and on the ring-shaped body to eliminate any edges upon which the annular lip of the golf club grips could catch when the clubs are being extracted from the golf bag.

In a first embodiment of the golf bag throat structure of the present invention, the ring-shaped body and the divider means are molded or otherwise formed as a unitary structure from a suitable synthetic resin. In a second embodiment, the divider means and the ring-shaped body are made as separate pieces which are assembled during fabrication of a golf bag. The assembly may be accomplished in various suitable ways, such as by using the well known sonic welding technique, or by the conventional method of threadingly passing a strap through the divider means and the ring-shaped body and using a buckle to demountably secure the strap, and thus the divider means, in the body.

Accordingly, it is an object of the present invention to provide a new and improved open top, or throat structure for use in golf bags.

Another object of the present invention is to provide a new and improved golf bag throat structure which is configured to provide improved golf club group segregation characteristics and has improved golf club extraction properties.

Another object of the present invention is to provide a new and improved throat structure for golf bags which includes a ring-shaped body having a divider means therein which provides four especially configured open and separated areas which inherently keeps golf club groupings in widely spaced locations during the carrying of the golf bag.

Another object of the present invention is to provide a new and improved golf bag throat structure of the above described character wherein the divider means includes a spaced pair of angular cross bars which are interconnected at their centers to provide the four open and separated golf club group segregation areas.

Another object of the present invention is to provide a new and improved golf bag throat structure of the above described character wherein the angular divider means is configured to provide a first pair of diametrically opposed open segregation areas and a second pair of diametrically opposed open segregation areas with the second pair being transversely disposed with respect to the first pair.

Another object of the present invention is to provide a new and improved golf bag throat structure of the above described type wherein the angular cross bars face in opposite directions and each has an oppositely and angularly diverging pair of arms which define an included obtuse angle with adjacent pairs of the arms of the cross bars defining an acute included angle.

Still another object of the present invention is to provide a new and improved golf bag throat structure of the above described character wherein the corners of each of the four open and separated golf club segregation areas are formed with radii which are at least substantially equal to the largest radius provided on a golf club grip to minimize golf club hand-up, or catching on the throat structure when the clubs are being extracted from the golf bag.

Yet another object of the present invention is to provide a new and improved golf bag throat structure of the above described character and further including means for eliminating the downwardly facing edges of the throat structure to prevent the annular lip of the golf club grips from catching on those edges when the golf clubs are being extracted from the golf bag.

The foregoing and other objects of the present invention as well as the invention itself, may be more fully understood from the following description when read in conjunction with the accompanying drawings.

BRIEF DESCRIPTION OF THE DRAWINGS

FIG. 4 is a perspective view showing the throat structure of this first embodiment and a plug means in exploded relationship therewith which provides means for eliminating the downwardly facing edges of the throat structure.

FIG. 6 is an exploded perspective view of a second embodiment of the present invention showing the fabrication of a divider means as a separate piece.

FIG. 7 is a perspective view showing the separate divider means in an assembled condition and showing it in exploded relationship with a first type of ring-shaped body into which it is to be assembled.

FIG. 9 is a sectional view similar to FIG. 3 and showing the divider means and ring-shaped body of FIG. 7 in the assembled state.

FIG. 10 is a plan view similar to FIG. 2 and showing the separate divider means of FIGS. 6, 7, 8 in an installed position within another form of ring-shaped body.

FIG. 11 is an enlarged fragmentary sectional view taken along the line 11—11 of FIG. 10.

FIG. 12 is an enlarged fragmentary sectional view taken along the line 12—12 of FIG. 10.

DESCRIPTION OF THE PREFERRED EMBODIMENT

Figure 1:
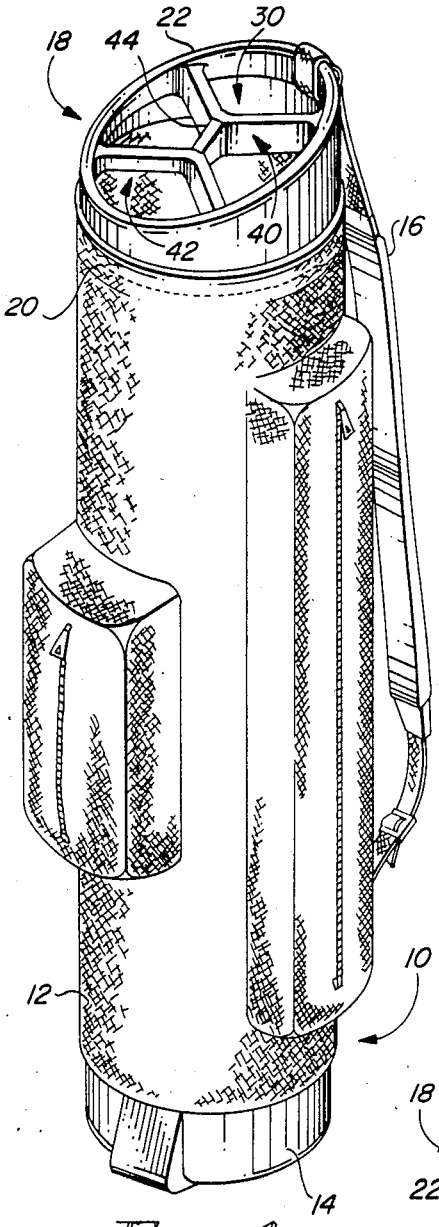
FIG. 1 is a perspective view of a typical golf bag which is provided with the throat structure of the present invention.

Referring more particularly to the drawings, FIG. 1 shows a typical type of golf bag structure which is identified in its entirety by the reference numeral 10. As is customary, the golf bag 10 includes a tubular container body 12 which, in light weight and relatively small golf bags, such as the one shown in FIG. 1, is usually formed of a suitable synthetic material, such as nylon. The bag 10 further includes a bottom closure member 14 which is a cup-shaped rigid structure that is stitched or otherwise fastened in the bottom of the tubular body 12. A suitable carrying strap 16 is also provided as is customary.

As will hereinafter be described in detail, the golf bag 10 is provided with an especially configured open top, or throat structure 18, which is suitably mounted in the top of the tubular container body 12 such as by sewing as indicated at 20 in FIG. 1.

Figure 2:
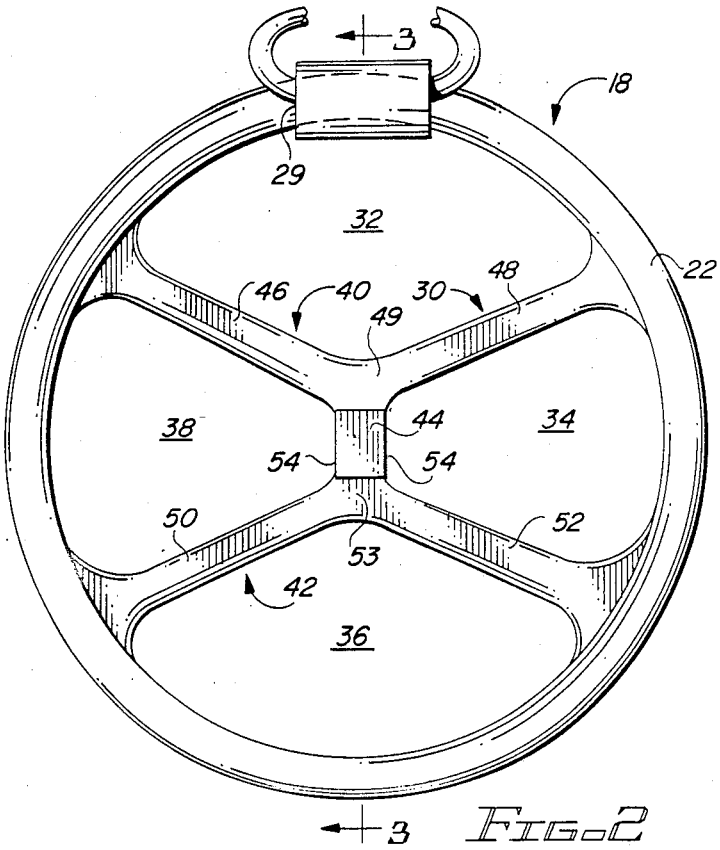
FIG. 2 is an enlarged plan view of a first embodiment of the golf bag throat structure of the present invention showing the various features thereof.
Figure 3:
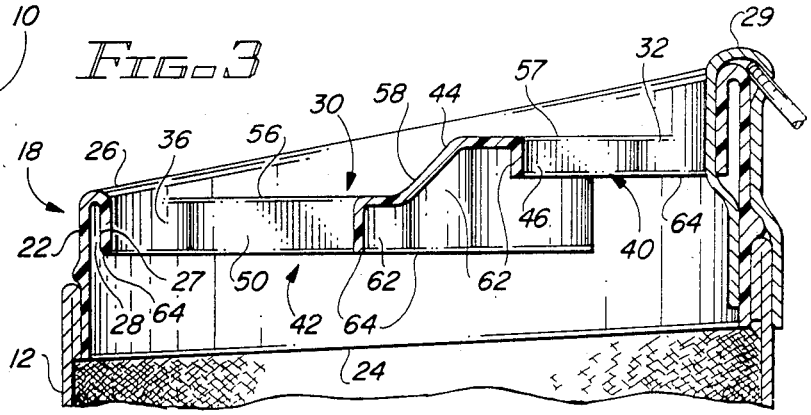
FIG. 3 is a sectional view taken along the line 3—3 of FIG. 2.

As seen best in FIGS. 2 and 3, the throat structure 18 includes a ring-shaped body 22 of substantially cylindrical configuration, with the lower or inner edge 24 lying in a plane transverse to the axis of the body and the upper edge 26 being rolled over as shown to provide an inwardly spaced lip 27 which is concentric with the body 22 and defines a downwardly opening annular groove 28 therebetween. The upper edge 26 lies in a plane which is angularly disposed with respect to the axis of the body 22. This angular orientation of the upper edge 26, or the known alternative of an axially offset two-tier, or stepped upper edge (not shown) of the ring-shaped body, is well known in the art and is employed for access and bag balancing purposes.

As shown, the carrying strap 16 is attached to the highest point on the ring-shaped body 22. This is done for the above mentioned bag balancing purpose and the strap 16 may be attached in various ways, such as by means of a suitable flap 29 which is looped over the ring-shaped body 22 and is suitably secured thereto so as to captively retain a metallic ring to which the strap 16 is demountably attached such as by means of a suitable clip (not shown).

The throat structure 18 further includes a divider means 30 which, in this first embodiment, is molded or otherwise integrally formed with the ring-shaped body 22. The divider means 30 is configured to divide the bore of the ring-shaped body into four open golf club segregating areas, 32, 34, 36 and 38, and this is accomplished by a pair of cross bars 40 and 42, which are spaced apart and having their centers interconnected by a transverse rib 44. The cross bars 40 and 42 are curved or otherwise bent at their centers to provide the cross bar 40 with a pair of arms 46 and 48 which extend at a diverging angle from the vertex 49 located at one end of the transverse rib 44 and to similarly provide the other cross bar 42 with a pair of arms 50 and 52 which extend at an oppositely facing diverging angle from the vertex 53 located at the opposite end of the rib 44. The diverging, or included angles between the arms 46 and 48 of the cross bar 40 and the arms 50 and 52 of the cross bar 42 are preferably obtuse which of course, results in the included angles between the adjacent arms 46 and 50, and the adjacent arms 48 and 52 being acute. The specific angles are not critical, however, excellent golf club group segregating characteristics result from orienting the arms 46, 48, 50 and 52 of the cross bars 40 and 42, respectively, so that the included obtuse angles are approximately 130°, and the acute included angles are approximately 50°. When configured in this manner, the diametrically opposed pair of open segregating areas 32 and 36 are relatively large and ideal for segregating, for example, the woods of a golf club set (not shown) in the area 32, with the putter and short distance irons in the area 36. The transverse diametrically opposed open areas 34 and 38 are relatively smaller and are ideal for jointly segregating the middle and long distance irons of the golf club set (not shown).

When a golf bag is being carried by means of the shoulder strap 16, it will normally be oriented so that the open area 32 will be at the top or upper part of the body 22, the open area 36 will be at the lower part of the body, and the open areas 34 and 38 will be intermediate and laterally disposed in the ring-shaped body. This type of orientation is indicated best in FIG. 2, and due to the above described angular relationships of arms 46, 48 and 50, 52, of the divider cross bars 40 and 42, respectively, the golf club groupings (not shown) containable in the upper open segregation area 32 will tend to gather and stay at the center of that cross bar. Of course, all the clubs can't simultaneously occupy the exact central location. Therefore, the clubs will be spread along the cross bar somewhat. Due to this, the heads of the clubs located in the upper segregation area 32 will hang down, and thus more or less overlay the transverse rib 44. The golf club grouping in the open bottom segregation area 36 will similarly gather and stay in the center part of the arcuate portion of the ring-shaped body 22 which defines the lower part of the bottom area, as is usual in most golf bags. The heads of the clubs located in the open bottom area 36 will hang down and thus not overlay any portion of the bore of the ring-shaped body. The right hand, as viewed in FIG. 2, intermediate area 34 is configured so that the golf club grouping containable in that area will tend to gather and stay in the corner formed at the intersection of the downwardly angularly extending arm 52 and that arcuate portion of the ring-shaped body 22 which bounds the right hand side of the open area 34. Some of the heads of the clubs containable in the right hand open segregation area 34 will hang down over the right hand side of the bottom open area 36 while others will be outside of the ring-shaped body 22 to the right and somewhat above the heads of the clubs containable in the bottom segregation area 36. Similarly, the golf club grouping containable in the left hand intermediate open segregation area 38 will tend to gather and stay in the lower left corner formed by the intersection of the angularly and downwardly sloping arm 50 and the arcuate portion of the ring-shaped body 22 which defines the left side of the open area 38. The heads of the clubs containable in that open area 38 will hang down in the same manner as those in the right hand open area 34 and thus will be generally to the left of the center of the open bottom area 36.

As shown, the opposite sides of the transverse rib 44 are curved as indicated at 54 in FIG. 2. The extending ends of the arms 46, 48, 50 and 52, are also curved, or flared, at the junctions of those arms with the ring-shaped body 22, and the cross bars 40 and 42 are curved in the central areas thereof where they are bent. Therefore, each corner within the entire throat structure 18 has a relatively large radius, and those radii are selected to minimize the catching, or hanging-up of the golf clubs when they are being extracted from the golf bag 10. The different corner radii in the throat structure 18 are sized so that they are at least substantially equal to the radius of the largest part of golf club grips. In this manner, problems of the clubs becoming wedgingly caught in the corners of the throat structure, and the lips of the golf club grips catching in those radiused corners is substantially reduced.

As seen in FIG. 3, the divider means 30 is preferably recessed axially from the top surface 26 of the ring-shaped body 22. And, the divider means 30 is preferably configured so that the upper surfaces 56 and 57 of the cross bars 40 and 42, respectively, lie in different axially spaced parallel planes, and the upper surface 58 of the transverse rib 44 extends angularly between the cross bars to form a transition surface. None of these features are critical in that the objectives of the invention would be achieved with no axial recessing of the divider means 30, or by being further recessed than is shown, and, obviously, the axially spaced top surface placement of the divider means 30 may be varied.

Figure 5:
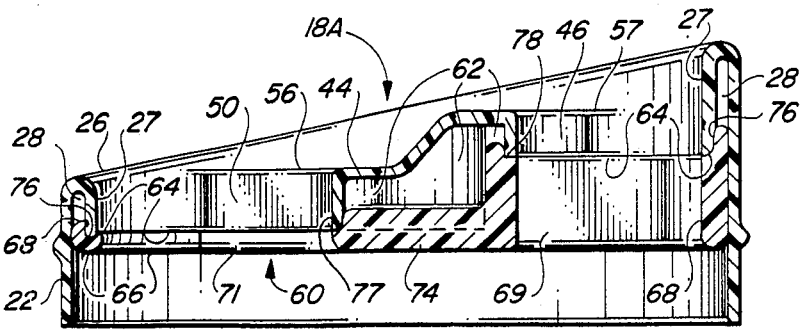
FIG. 5 is a sectional view similar to FIG. 3 and showing the plug means of FIG. 4 in the installed position within the throat structure.

Reference is now made to FIGS. 4 and 5 wherein a modified form of the hereinbefore described throat structure 18 is shown. FIG. 4 shows the throat structure 18 with a plug insert means 60 which, when assembled to the throat structure 18, as will hereinafter be described, provides the modified throat structure 18A shown in section in FIG. 5.

The throat structure 18 is preferably molded as a unitary structure from a suitable synthetic resin. This fabrication technique dictates, as is well known in the art, that the throat structure 18 be formed with the previously mentioned annular groove 28 between the ring-shaped body 22 and the inwardly spaced concentric lip 27. This same fabrication requirement also forms downwardly, or inwardly, opening slots 62 in each of the divider arms 46, 48, 50 and 52 and in the transverse rib 44. The downwardly opening annular groove 28 and the downwardly opening slots 62 provide a plurality of downwardly facing edges 64 both on the ring-shaped body 22 and on the divider means 30. These edges 64, which face into the golf bag 10, when the throat structure 18 is attached thereto, are a primary cause of catching, or hanging up of the golf clubs when they are being extracted from the golf bag 10. The annular lip formed by the golf club grips (not shown) can catch on those inwardly facing edges 64, and often do in prior art throat structures, and in addition to catching, the grips can tear.

The plug insert means 60 is designed to fit into the annular groove 28 and the slots 62 defined by the throat structure 18 to fill groove and slots and present a downwardly curved surface 66 which covers the edges 64. Therefore, the plug means 60 is an integral structure provided with a peripheral ring-shaped body 68 having divider struts 69, 70, 71 and 72 for filling the slots 62 of the divider arms 46, 48, 50 and 52 respectively, and a central strut 74 for filling the slot 62 of the center rib 44 of the divider means.

As shown best in FIG. 5, the ring-shaped body 68 of the plug means 60 has the downwardly facing curved surface 66 and has an upwardly and inwardly opening groove 76 formed therein into which the bottom edge 64 of the concentric lip 27 of the ring-shaped body 22 is received. The divider struts 69, 70, 71 and 72 and the central strut 74 of the plug means 60 also have the downwardly facing curved surface 66 thereon, and also have an oppositely disposed pair of upwardly and laterally opening grooves 77 and 78 into which the bottom edges 64 of the divider arms 46, 48, 50 and 52 and the transverse rib 44 are received.

Due to the preferred angular orientation of the upper edge 26 of the ring-shaped body 22, and the upper surfaces 56 and 57 being disposed in axially spaced planes, the bottom edge 64 of the concentric lip 27 lies in two different planes and the bottom edges 64 of the two cross bars 40 and 42 also lie in two different planes. For this reason, the plug insert means 60 is shown with a portion thereof being vertically extended as indicated in FIG. 4.

The plug insert means 60 is preferably molded or otherwise formed of a synthetic resin which is the same as that used in forming the throat structure 18, or is compatible with that material, to allow the throat structure 18 and the plug means 60 to be permanently assembled to each other, such as by using the well known sonic welding technique, and thereby forming the modified throat structure 18A.

The hereinbefore described throat structure 18 is formed as a single piece including the ring-shaped body 22 and the divider means 30. In the second embodiment of the present invention, a modified form of divider means 80 is fabricated as a separate structure for subsequent assembly to various types of ring-shaped bodies.

Figure 8:
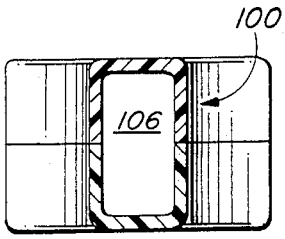
FIG. 8 is an enlarged sectional view taken along the line 8—8 of FIG. 6.

As shown in FIGS. 6, 7 and 8, the modified divider means 80 includes an identical pair of divider halves 81 and 82 each of which is molded or otherwise formed to be essentially the same as the above described divider means 30. In that the divider halves 81 and 82 are identical, the following description of the divider half 81 will be understood to also apply to the other divider half 82. The divider half 81 includes a pair of cross bars 84 and 86 which are spaced apart and have their centers interconnected by a transverse rib 88. The cross bars 84 and 86 are curved or otherwise bent at their centers to provide the cross bar 84 with a pair of arms 90 and 92 which extend at a diverging angle from the vertex 93 which is located at one end of the transverse rib 88 and to similarly provide the other cross bar 86 with a pair of arms 94 and 96 which extend at an oppositely facing diverging angle from the vertex 97. The diverging, or included, angle between the arms 90 and 92 of the cross bar 84 and between the arms 94 and 96 of the cross bar 86 are preferably obtuse which, of course, results in the included angles between the adjacent arms 90 and 94 and the adjacent arms 92 and 96 being acute. As was the case with the above described divider means 30, the obtuse angles are preferably about 130° and the acute angles are about 50°. However, those angles are not particularly critical.

The identical pair of divider halves 81 and 82 are molded or otherwise formed from a suitable synthetic resin and therefore define an open slot 98 in each of the cross bars 84 and 86 and in the transverse ribs 88. In order to close those slots 98, and thereby prevent catching or hanging up of golf clubs being extracted, the divider half 81 is positioned in what may be described as a right-side-up position and the divider half 82 is positioned in an inverted position as shown in FIG. 6, and are assembled, such as by sonic welding, to form the unitary divider means 80 as shown in FIG. 7.

The unitary divider means 80 formed in the above described manner defines cross bars 100 and 102 which are cooperatively formed by the joined cross bars 84 and 86 of the divider halves 81 and 82 and a transverse rib 104 which is cooperatively formed by the joined transverse ribs 88 of the divider halves.

Therefore, the divider means 80 is of tubular configuration with an open ended passage 106 extending through the first cross bar 100 and a similar passage 108 extending through the second cross bar 102.

The divider means 80 is located in a ring-shaped body 110 and is fixedly mounted therein, such as by the above suggested sonic welding technique, to complete the manufacture of the throat structure 112 of this second embodiment of the present invention, which may be further provided with the illustrated plug-insert means 114, if desired.

As seen best in the sectional view of FIG. 9, the ring-shaped body 110 is formed in the same manner as the hereinbefore described body 22 and therefore includes an upper edge 115 which extends inwardly and has an integrally formed depending concentric lip 116 with a downwardly opening annular groove 118 being defined between the ring-shaped body and the concentric lip. The above mentioned plug means 114 is employed to close the downwardly opening annular groove 118 of the ring-shaped body in the manner hereinbefore fully described with reference to the throat structure 18A.

The hereinbefore described throat structures are suitable for use with many golf bags, particularly the light weight relatively small carrying bags. However, they are not suited for use in some golf bags, mainly the larger and heavier golf bags due to the manner in which such bags are normally made. In such golf bags, it is a common practice to use a rigid ring 120, such as of metal, which is wrapped in the vinyl coated cloth, or equivalent, material 121 of which the bag is made, as shown in FIGS. 10, 11 and 12, so that the ring 120 is an enclosed integral part of the golf bag.

When the ring-shaped body is an integral part of the golf bag, the above described divider means 80 is used as an insert which is mounted in the throat of the golf bag by means of an elongated strap 124. The divider means 80 is placed in the throat of the golf bag so that the open ends of the cross bars 100 and 102 are in alignment with slots 126 which are formed through the ring-shaped body 120. The strap 124 is threaded through the eyelets 128, or grommets, provided in the slots 126 and through the passages 106 and 108 defined in the divider means 80 with the opposite ends of the strap being joined exteriorly of the golf bag such as by means of a suitable buckle 130.

While the principles of the invention have now been made clear in the illustrated embodiments, there will be immediately obvious to those skilled in the art, many modifications of structure, arrangements, proportions, the elements, materials and components use in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A throat structure for the top end of a golf bag comprising:

(a) a ring-shaped body defining a bore;

(b) divider means in the bore of said ring-shaped body to divide the bore into four separated open golf club segregation areas, said divider means including:

I. a first cross bar including a pair of arms which extend oppositely and angularly from a central vertex with those arms being disposed to define an obtuse included angle therebetween, II. a second cross bar including a pair of arms which extend oppositely and angularly from a central vertex with those arms being disposed to define an obtuse included angle therebetween, III. said first and second cross bars being disposed so that the included obtuse angles defined by their respective pairs of arms face in opposite directions and their respective vertices are in aligned spaced apart positions relative to each other, IV. a transverse rib interconnecting the aligned spaced apart vertices of said first and second cross bars; and (c) means for providing curved closed surfaces on the edges of said ring-shaped body and said divider means which face into the golf bag when mounted on the top end thereof.

2. A throat structure as claimed in claim 1 and further comprising:

(a) said ring-shaped body having an end which faces outwardly and an opposite end which faces inwardly when mounted on the top end of the golf bag, said ring-shaped body being configured to define an annular groove which opens toward the inwardly facing end thereof;

(b) said first and second cross bars and said transverse rib of said divider means having cross sectional configurations which define slots that open toward the inwardly facing end of said ring-shaped body; and (c) said means for providing curved closed surfaces being in the form of a plug in the open end of the annular groove of said ring-shaped body and in the open slots of said first and second cross bars and said transverse rib of said divider means for closing thereof.

3. A throat structure as claimed in claim 2 wherein said plug has a curved surface which faces the inwardly facing end of said ring-shaped body.

4. A throat structure as claimed in claim 1 and further comprising:

(a) said ring-shaped body having an outer end which faces outwardly and an opposite end which faces inwardly when mounted on the top end of the golf bag, said ring-shaped body having its outer end rolled inwardly from said ring-shaped body and an integral depending concentric lip which is spaced inwardly from said ring-shaped body to define an annular groove which opens toward the inwardly facing end of said ring-shaped body;

(b) said divider means being integrally formed with said ring-shaped body with the opposite ends of said first and second cross bars being joined to the concentric lip thereof, said first and second cross bars and said transverse rib being configured to present closed surfaces which face the outwardly facing end of said ring-shaped body and define open slots which face the inwardly facing end of said ring-shaped body; and (c) said means for providing curved closed surfaces being in the form of a plug in the annular groove defined by said ring shaped body and the concentric lip thereof and in the slots defined by said first and second cross bars and said transverse rib to provide the curved closed surfaces which face the inwardly facing end of said ring-shaped body.

5. A throat structure as claimed in claim 1 and further comprising:

(a) said ring-shaped body having an end which faces outwardly and an opposite end which faces inwardly when mounted on the top end of the golf bag, said ring-shaped body having its outwardly facing end rolled inwardly and an integral depending concentric lip which is spaced inwardly from said ring-shaped body to define an annular groove which opens in the direction of the inwardly facing end of said ring-shaped body;

(b) said first and second cross bars and said transverse rib of said divider means being of tubular configuration to provide oppositely facing closed surfaces and to define open ended passages through said first and second cross bars;

(c) said divider means being mounted in the bore of said ring-shaped body by having the opposite ends of said first and second cross bars fixedly attached to the concentric lip thereof; and (d) said means for providing curved closed surfaces being in the form of a plug in the annular groove defined by said ring-shaped body and the concentric lip thereof to provide a closing surface in the open end of the annular groove.

6. A throat structure for the top end of a golf bag comprising:

(a) a ring-shaped body defining a bore and having an end which faces outwardly and an opposite end which faces inwardly when mounted on the top end of the golf bag, said ring-shaped body having its outwardly facing end rolled inwardly and an integral depending concentric lip which is spaced inwardly from said ring-shaped body to define an annular groove which opens in the direction of the inwardly facing end of said ring-shaped body;

(b) divider means mounted in the bore of said ring-shaped body to divide the bore into four separated open golf club segregation areas, said divider means including:

I. a first cross bar including a pair of arms which extend oppositely and angularly from a central vertex with those arms being disposed to define an obtuse included angle therebetween, II. a second cross bar including a pair of arms which extend oppositely and angularly from a central vertex with those arms being disposed to define an obtuse included angle therebetween, III. said first and second cross bars being disposed so that the included obtuse angles defined by their respective pairs of arms face in opposite directions and their respective vertices are in aligned spaced apart positions relative to each other, IV. a transverse rib interconnection the aligned spaced apart vertices of said first and second cross bars;

(c) said divider means being formed of first and second divider halves which are identical to each other and are fixedly attached to each other in oppositely facing directions to provide said first and second cross bars and said transverse rib with tubular configurations having oppositely facing closed surfaces and to define open ended passages through said first and second cross bars;

(d) said divider means being mounted in the bore of said ring-shaped body by having the opposite ends of said first and second cross bars fixedly attached to the concentric lip thereof; and (e) plug means in the annular groove defined by said ring-shaped body and the concentric lip thereof to provide a closing surface in the open end of the annular groove.

7. A throat structure for the top end of a golf bag comprising:

(a) a ring-shaped body defining a bore;

(b) divider means in the bore of said ring-shaped body to divide the bore into four separated open golf club segregation areas, said divider means including, I. a first cross bar including a pair of arms which extend oppositely and angularly from a central vertex with those arms being disposed to define an obtuse included angle therebetween, II. a second cross bar including a pair of arms which extend oppositely and angularly from a central vertex with those arms being disposed to define an obtuse included angle therebetween, III. said first and second cross bars being disposed so that the included obtuse angles defined by their respective pairs of arms face in opposite directions and their respective vertices are in aligned spaced apart positions relative to each other, IV. a transverse rib interconnection the aligned spaced apart vertices of said first and second cross bars;

(c) said divider means being formed of first and second divider halves which are identical to each other and are fixedly attached to each other in oppositely facing directions to provide said first and second cross bars and said transverse rib with tubular configurations having oppositely facing closed surfaces and to define open ended passages through said first and second cross bars;

(d) said ring-shaped body having four slots formed therethrough each being disposed to align with a different one of the open ends of said first and second cross bars of said divider means;

(e) strap means passing through the passages of said first and second cross bars and through the slots of said ring-shaped body in a manner which places the opposite ends of said strap means proximate each other on the periphery of said ring-shaped body for demountably mounting said divider means in the bore thereof; and (f) means for releasably interconnecting the opposite ends of said strap means.

8. A golf bag for carrying golf clubs in segregated groups comprising, in combination:

(a) a golf bag having an elongated tubular container with means for closing one end and having an opposite open end;

(b) a ring-shaped body at the open end of said golf bag, said body defining a bore having diametrically opposed top and bottom portions and a diametrically opposed pair of side portions when said golf bag is in a normal carrying attitude; and (c) divider means in the bore of said body to separate the diametrically opposed top and bottom portion and the pair of side portions from each other, said divider means including, I. a first cross bar including a pair of arms which extend oppositely and angularly from a central vertex with those arms being disposed to define an obtuse included angle therebetween, II. a second cross bar including a pair of arms which extend oppositely and angularly from a central vertex with those arms being disposed to define an obtuse included angle therebetween, III. said first and second cross bars being disposed so that the obtuse angles defined thereby face in opposite directions and their respective vertices are in aligned spaced apart relationship with respect to each other, IV. a transverse rib interconnecting the aligned spaced apart vertices of said first and second cross bars.

9. A golf bag as claimed in claim 8 wherein said divider means is disposed in the bore of said body so that said first cross bar defines the bottom end of the top portion of the bore of said body and said second cross bar defines the top end of the bottom portion of the bore of said body.

10. A golf bag as claimed in claim 8 wherein the included angles defined by the pair of arms of said first cross bar and by the pair of arms of said second cross bar are of approximately 130°.

11. A golf bag as claimed in claim 8 wherein said divider means and said ring-shaped body are formed as an integral unitary structure.

12. A golf bag structure as claimed in claim 8 and further comprising means for providing curved closed surfaces on the edges of said ring-shaped body and said divider means which face into said golf bag.

13. A golf bag as claimed in claim 8 and further comprising:

(a) said ring-shaped body having an end which faces outwardly and an opposite end which faces inwardly with respect to said golf bag, said ring-shaped body being configured to define an annular groove which opens toward the inwardly facing end thereof;

(b) said first and second cross bars and said transverse rib of said divider means having cross sectional configurations which define slots that open toward the inwardly facing end of said ring-shaped body; and (c) plug means in the open end of the annular groove of said ring-shaped body and in the open slots of said first and second cross bars and said transverse rib of said divider means for closing thereof.

14. A golf bag as claimed in claim 13 wherein said plug means defines a surface which faces the inwardly facing end of said ring-shaped body.

15. A golf bag as claimed in claim 8 and further comprising:

(a) said ring-shaped body having an outer end which faces outwardly and an opposite end which faces inwardly with respect to said golf bag, said ring-shaped body having its outer end extending inwardly and an integral depending concentric lip which is spaced inwardly from said ring-shaped body to define an annular groove which opens toward the inwardly facing end of said ring-shaped body;

(b) said divider means being integrally formed with said ring-shaped body with the opposite ends of said first and second cross bars being joined to the concentric lip thereof, said first and second cross bars and said transverse rib being configured to present closed surfaces which face the outwardly facing end of said ring-shaped body and define open slots which face the inwardly facing end of said ring-shaped body; and (c) plug means in the annular groove defined by said ring-shaped body and the concentric lip thereof and in the slots defined by said first and second cross bars and said transverse rib to provide closing surfaces which face the inwardly facing end of said ring-shaped body.

16. A golf bag as claimed in claim 8 wherein said first and second cross bars and said transverse rib of said divider means are of tubular configuration to provide oppositely facing closed surfaces and to define open ended passages through said first and second cross bars.

17. A golf bag as claimed in claim 16 wherein said divider means is mounted in the bore of said ring-shaped body by having the opposite ends of said first and second cross bars fixedly attached to said ring-shaped body.

18. A golf bag as claimed in claim 16 and further comprising:

(a) said ring-shaped body having an end which faces outwardly and an opposite end which faces inwardly with respect to said golf bag, said ring-shaped body having its outwardly facing end extending inwardly and an integral depending concentric lip which is spaced inwardly from said ring-shaped body to define an annular groove which opens in the direction of the inwardly facing end of said ring-shaped body;

(b) said divider means being mounted in the bore of said ring-shaped body by having the opposite ends of said first and second cross bars fixedly attached to the concentric lip thereof; and (c) plug means in the annular groove defined by said ring-shaped body and the concentric lip thereof to provide a closing surface in the open end of the annular groove.

19. A golf bag as claimed in claim 16 and further comprising:

(a) said ring-shaped body having four slots formed therethrough each of which aligns with a different one of the open ends of said first and second cross bars of said divider means;

(b) strap means passing through the open ended passages of said first and second cross bars and through the slots of said ring-shaped body in a manner which places the opposite ends of said strap means proximate each other on the periphery of said ring-shaped body for demountably mounting said divider means in the bore thereof; and (c) means for releasably interconnecting the opposite ends of said strap means.

20. A golf bag as claimed in claim 8 wherein said divider means further comprises first and second divider halves which are identical to each other and are fixedly attached to each other in oppositely facing directions to provide said first and second cross bars and said transverse rib with tubular configurations having oppositely facing closed surfaces and to define open ended passages through said first and second cross bars.

21. A golf bag as claimed in claim 20 wherein said divider means is mounted in the bore of said ring-shaped body by having the opposite ends of said first and second cross bars fixedly attached to said ring-shaped body.

22. A golf bag as claimed in claim 20 and further comprising:

(a) said ring-shaped body having an end which faces outwardly and an opposite end which faces inwardly with respect to said golf bag, said ring-shaped body having its outwardly facing end extending inwardly and an integral depending concentric lip which is spaced inwardly from said ring-shaped body to define an annular groove which opens in the direction of the inwardly facing end of said ring-shaped body;

(b) said divider means being mounted in the bore of said ring-shaped body by having the opposite ends of said first and second cross bars fixedly attached to the concentric lip thereof; and (c) plug means in the annular groove defined by said ring-shaped body and the concentric lip thereof to provide a closing surface in the open end of the annular groove.

23. A golf bag as claimed in claim 20 and further comprising:

(a) said ring-shaped body having four slots formed therethrough each being disposed to align with a different one of the open ends of said first and second cross bars of said divider means;

(b) strap means passing through the passages of said first and second cross bars and through the slots of said ring-shaped body in a manner which places the opposite ends of said strap means proximate each other on the periphery of said ring-shaped body for demountably mounting said divider means in the bore thereof; and (c) means for releasably interconnecting the opposite ends of said strap means.

* * * * *